US011814906B2

(12) United States Patent
Nordbeck et al.

(10) Patent No.: US 11,814,906 B2
(45) Date of Patent: Nov. 14, 2023

(54) ONSHORE DRILLING RIG AND METHOD FOR MOVING A TOP DRIVE IN A DRILL MAST OF AN ONSHORE DRILLING RIG

(71) Applicant: BENTEC GMBH DRILLING & OILFIELD SYSTEMS, Bad Bentheim (DE)

(72) Inventors: Achim Nordbeck, Bad Bentheim (DE); Arend Lödden, Bad Bentheim (DE)

(73) Assignee: Bentec GmbH Drilling and Oilfield Systems, Bad Bentheim (DE)

( * ) Notice: Subject to any disclaimer, the term of this patent is extended or adjusted under 35 U.S.C. 154(b) by 29 days.

(21) Appl. No.: 17/608,986

(22) PCT Filed: May 7, 2020

(86) PCT No.: PCT/EP2020/062724

§ 371 (c)(1),
(2) Date: Nov. 4, 2021

(87) PCT Pub. No.: WO2020/225368

PCT Pub. Date: Nov. 12, 2020

(65) Prior Publication Data

US 2022/0235614 A1 Jul. 28, 2022

(30) Foreign Application Priority Data

May 8, 2019 (DE) ..... 10 2019 206 598.8

(51) Int. Cl.

| | |
|---|---|
| ***E21B 15/02*** | (2006.01) |
| ***E21B 19/02*** | (2006.01) |
| ***E21B 19/14*** | (2006.01) |
| ***E21B 19/16*** | (2006.01) |
| ***E21B 19/09*** | (2006.01) |

(52) U.S. Cl.
CPC ..... *E21B 15/02* (2013.01); *E21B 19/02* (2013.01); *E21B 19/143* (2013.01); *E21B 19/16* (2013.01); *E21B 19/09* (2013.01)

(58) Field of Classification Search
CPC ..... E21B 15/02; E21B 19/02; E21B 19/143; E21B 19/16; E21B 19/09
See application file for complete search history.

(56) References Cited

U.S. PATENT DOCUMENTS 2,643,005 A 6/1953 Jarnett
4,850,439 A * 7/1989 Lund ..... E21B 19/20 175/57

(Continued)

FOREIGN PATENT DOCUMENTS

DE 102014200748 7/2015

OTHER PUBLICATIONS

International Search Report of Counterpart PCT International Application No. PCT/EP2020/062724.

*Primary Examiner* — Aaron L Lembo
(74) *Attorney, Agent, or Firm* — LIU & LIU

(57) ABSTRACT

The invention is a land drilling rig (10) having a drilling mast (12), a top drive (14) movable in the drilling mast (12) along the vertical axis of the drilling mast (12), and a crown bearing (18) at an upper end (16) of the drilling mast (12), the crown bearing (18) being movable by means of a positioning device (24), and a method of operating such a drilling rig (10) and a method of operating a top drive (14) in the drilling mast (12) of such a drilling rig (10).

11 Claims, 4 Drawing Sheets

(56) References Cited

U.S. PATENT DOCUMENTS

| | | | | |
|---|---|---|---|---|
| 4,903,443 | A | 2/1990 | Reed | |
| 5,762,279 | A * | 6/1998 | Horton, III | E21B 19/02 254/285 |
| 8,893,825 | B1 * | 11/2014 | Akerman | E21B 17/07 175/162 |
| 10,202,808 | B2 * | 2/2019 | Kannegaard | E21B 7/12 |
| 10,570,672 | B2 * | 2/2020 | Kannegaard | E21B 19/143 |
| 11,512,532 | B2 * | 11/2022 | De Mul | E21B 3/02 |
| 2001/0025727 | A1 | 10/2001 | Byrt et al. | |

* cited by examiner

ONSHORE DRILLING RIG AND METHOD FOR MOVING A TOP DRIVE IN A DRILL MAST OF AN ONSHORE DRILLING RIG

BACKGROUND OF THE INVENTION

1. Field of the Invention

The invention relates to a land drilling rig, hereinafter sometimes briefly referred to as a drilling rig, for sinking deep wells, for example on hydrocarbon reservoirs, for oil and gas exploration or for geothermal energy development. The invention further relates to a method for moving a so-called top drive (power head) in a drilling mast of a land drilling rig, as well as a method for the so-called removal of a drill string from a borehole and a method for the so-called installation of a drill string in a borehole.

2. Description of Related Art

A critical aspect of operating a land drilling rig is the time-dependent costs. The installation and removal of the drill string is particularly time-consuming. This is necessary, for example, when replacing a drill head. The removal of a drill string and the subsequent installation (reinstallation) of a drill string is also referred to as a "round trip". The length of time it takes to remove and install a drill string is also known as the "trip rate". A short trip rate is an essential criterion for the costs of a drilling project and accordingly an essential differentiating factor for suppliers of a drilling rig.

SUMMARY OF THE INVENTION

One object of the present invention is to provide a drilling rig, in particular a drilling mast of a drilling rig, which enables a reduction in the time required for a round trip.

The drilling rig proposed herein comprises, in a manner known per se, a drilling mast, a power head movable in the drilling mast along the vertical axis of the drilling mast and referred to in technical terminology as a top drive, and a crown block (crown bearing) referred to in technical terminology as a crown block at the upper end (head end) of the drilling mast. The special feature is that the crown bearing is movable, namely translationally movable, in particular translationally movable transversely to the vertical axis of the drilling mast.

A crown bearing positioning device, hereinafter briefly referred to as a positioning device, is provided for moving the crown bearing. The drilling rig or drilling mast comprises such a positioning device which is designed and arranged to move the crown bearing in operation, and which moves the crown bearing in operation as designed. The positioning device is designed and arranged to move the crown bearing back and forth between at least two different positions (first position; second position) as required. The positioning device is or comprises a device which, in operation, moves the crown bearing as required into the first position, into the second position and, if necessary, into further positions and holds it in the respective position. The positioning device is, for example, a drive or comprises, for example, at least one drive.

In the first position of the crown bearing, the top drive suspended below the crown bearing and at least indirectly suspended from the crown bearing is located above the centre of the borehole and accordingly at a position referred to as the borehole centre. The top drive is always located above the borehole centre when the drill string is raised, lowered or rotated by means of the top drive. The first position of the crown bearing in which the top drive is located above the borehole centre is also referred to as "borehole centre" or "above the borehole centre"; both designations mean the same thing. In the second position, the crown bearing is located in a position spaced from the borehole centre. This position is hereinafter referred to as the retracted position.

The borehole centre is any position above the borehole centre or any position along an axis defined by the drill string in the borehole (borehole centre axis). A retracted position is any position along a further axis that is parallel to the borehole centre axis and spaced from the borehole centre axis.

Such a land drilling rig can be briefly described as follows: A land drilling rig having a drilling mast, a top drive movable in the drilling mast along the vertical axis of the drilling mast and a crown bearing at an upper end of the drilling mast, wherein the crown bearing is movable by means of a positioning device.

Embodiments of such a land drilling rig may be briefly described as follows:

- The land drilling rig has a travel path for the crown bearing at the upper end of the drilling mast and a travel or displacement device acting as a positioning device.
- The land drilling rig has a drive acting on the drilling mast on the one hand and on the crown bearing on the other hand as a travel or displacement device.
- The land drilling rig, namely the drive acting as a travel or displacement device, has at least one drive wheel which can be rotated by means of the drive (motor drive, electric motor) and runs in, on or at the travel path.

The mobility of the crown bearing according to the innovation proposed herein has the advantage that a top drive which is itself movable between the position above borehole centre and a retracted position can perform so-called load runs at the borehole centre and so-called idle runs in the retracted position.

Such mobility of the top drive (mobility between the borehole centre and a retracted position) is known per se for offshore drilling rigs, but not for land drilling rigs. This mobility is also present in the innovation proposed here. This mobility is realised by means of a further positioning device, hereinafter referred to as an expander device for the purpose of differentiation.

The top drive is movable vertically in the drill mast along a guide in a manner known per se, in particular along a guide attached to the drilling mast. The expander device engages the guide directly or indirectly and the top drive is located at the opposite end of the expander device. This means that the expander device moves with the top drive in the mast and can in principle also be regarded as part of the top drive. By means of the expander device, the top drive is movable into a first plane and into a second plane, each parallel to a plane defined by the guide. Such an expander device is in principle known per se, so that in this respect reference can be made to the state of the art. A scissors-type lifting mechanism, for example, functions as the expander device, which is effective in the horizontal direction for the purpose of "expanding" the top drive from the guide, i.e. for moving the top drive into the position above the borehole centre.

The top drive supports itself against the guide when turning the drill string and for turning the drill string. The mechanical connection between the top drive and the guide is provided by the expander device. The guide and the expander device ensure (torque support) that the torque applied by means of the top drive causes the drill string to rotate.

In one of the two parallel planes in which the top drive is movable by means of the expander device, the top drive is located above the borehole centre (first plane; first position) and this first position is also referred to here as the position above the borehole centre or, in short, as the borehole centre. In the other plane (second plane; second position), the top drive is not above the borehole centre and this second position—analogous to the second position of the crown bearing—is referred to as the retracted position. When the top drive is moved in the drilling mast, the positioning device and the expander device are activated synchronously or at least substantially synchronously: In the case of a crown bearing moved into the position above the borehole centre by means of the positioning device during a load run of the top drive, the top drive is also moved into the position above the borehole centre (into the first plane) by means of the expander device; in the case of a crown bearing moved into the retracted position by means of the positioning device during an idle run of the top drive, the top drive is also moved into the retracted position (into the second plane) by means of the expander device.

During a load run, the top drive is located above the borehole centre and the drill string is suspended from the top drive. During a load run, the region above the borehole centre is thus occupied to a certain extent and not accessible to other machines. Examples of such other machines include a so-called pipe handler, a pincer system sometimes referred to in technical terminology as an iron roughneck for making and breaking threaded connections between two drill strings, or a rod handling device.

During installation and also during removal of a drill string, the top drive moves cyclically up and down in the drilling mast in a manner which is basically known per se, namely between a position at the end of an upward movement and a position at the end of a downward movement, which are hereinafter referred to in a simplified manner as "up in the mast" and "down in the mast", wherein an exact vertical position is not important. The position "up in the mast" is correlated with the height of simultaneously installed or removed drill strings. The position "down in the mast" is located in the region of the level of the so-called drill floor and slightly above the drill floor.

When installing and removing the drill string, a single drilling rod (single stand) can be installed or removed at a time. However, it is usual to install or remove two drill strings (double stand), three drill strings (triple stand) or even more than three drill strings at the same time. In the following, in the interest of better readability of the further description, an individually installed or removed drilling rod or a plurality of simultaneously installed or removed drilling rods will be collectively referred to as a drilling rod element.

The conventional process of installing or removing a drill string is briefly explained using the example of removal. When removing a drill string, the drill string is lifted by means of the top drive (load run) and pulled out of the borehole piece by piece. The removal of a drill string can be thought of as being divided into six substantial and cyclically repeating steps (see also the diagram in FIG. 3 and the associated explanation):

Step 1: The top drive moves to the position "up in the mast" which the top drive is coupled to the upper end of the drill string. The drill string is lifted to a height at which a drilling rod element (single stand, double stand etc.) is located in its entire length above the drill floor. In this raised position, the drill string is initially held by the top drive until a load is transferred.

Step 2: In order to be able to uncouple the top drive from the drill string, the drill string is axially fixed for a load transfer from the top drive. Such a fixation is carried out, for example, and in a manner that is basically known per se by means of wedges, namely by means of wedges in the drill floor. By means of such a fixation, the drill string is held independently of the top drive. The top drive still serves as a guide for the extracted drilling rod element.

Step 3: The guide of the extracted drilling rod element is carried out by a machine often referred to as a pipe handler in technical terminology. This acts as a rod handling device and is referred to hereinafter as the rod handling device. In order to take over the guide of the extracted drilling rod element, the rod handling device engages the drilling rod element in a manner which is basically known per se.

Step 4: The top drive can be released from the drill string after such a load transfer/takeover (step 2) and after such a takeover of the guide of the extracted drilling rod element (step 3) and is released from the drill string.

Step 5: A pincer system known per se engages the connection point (above the drill floor) of the extracted drilling rod element with the rest of the drill string and releases the extracted drilling rod element from the drill string, which is held by means of the rod handling device. The top drive, which has been uncoupled from the drill string, still remains up in the mast because the extracted drilling rod element is located at the position above the borehole centre, and thus blocks the way for the top drive to move downwards.

Step 6: The extracted drilling rod element, which is separated from the drill string, is removed from the region above the borehole centre by means of the drilling rod handling device and set down, for example, next to the drilling mast, in particular in a so-called finger platform.

The order of the steps can also be varied, such that the first step is performed first, then the second step, then the fifth step, then the third step, then the fourth step, and finally the sixth step.

After the sixth step, the region above the borehole centre is free again in the vertical direction. The top drive can be lowered to the position "down in the mast" (idle run) and is coupled to the drill string again there. Now the drill string is lifted again by means of the top drive (new load run) and the top drive moves again to the position "up in the mast" with the drill string extracted from the borehole a further distance. This process (steps 1 to 6) is repeated many times until the entire drill string is extracted from the borehole. For the installation of a drill string, the same applies in the reverse direction and sequence accordingly.

Since, according to the approach proposed herein, the crown bearing is movable at least between the borehole centre position and a retracted position, a top drive that is itself movable between the position above the borehole centre and a retracted position can perform an idle run in the retracted position. During the idle run, the top drive moves parallel to the axis of the drill string and in a plane parallel to the axis of the drill string. Similarly, during the idle run, the ropes of the pulley system between the crown bearing and the top drive run parallel or at least substantially parallel to the axis of the drill string. The course of the ropes of the pulley system parallel or at least substantially parallel to the axis of the drill string is hereinafter referred to in short as the pulley system parallel to the drill string.

The idle run takes place, for example, while the extracted drilling rod element is separated from the drill string and/or set down next to the mast. At the end of the idle run, the top drive is again at the position "down in the mast". Now—provided that the separation and setting down of the extracted drilling rod element has been completed—the crown bearing is moved back to the borehole centre position and the top drive is moved to the borehole centre position, so that the top drive can be coupled to the drill string again in the position "down in the mast".

The time during which the top drive moves parallel to the drilling rod element that has not yet been separated from the drill string or has not yet been set down is now saved when the drill string is removed. This time saving is achieved with every idle run (when removing the drill string and also when installing the drill string). This results in a significant reduction in the time required to remove and install a drill string, i.e. a significant reduction in the duration of a round trip.

In addition to this time saving, an advantage of the innovation proposed here is that a skew pull in the pulley system is avoided. A skew pull in the pulley system results when—as is known from offshore drilling rigs—the top drive is moved from the position above the borehole centre (below the crown bearing) to a retracted position. A skew pull unfavourably leads to horizontal loads in the guide of the top drive. Another advantage of the innovation proposed here is that a shorter horizontal travel path is required for the top drive between its position above the borehole centre and the retracted position. In the case of offshore drilling rigs and the known mobility of the top drive between the borehole centre and the retracted position, the retracted position must be far enough away from the position above the borehole centre that a collision of the pulley system with an extracted drilling rod element, in particular with the upper end of the extracted drilling rod element, can be safely excluded. This necessitates a significant distance between the retracted position and the position above the borehole centre and results in a corresponding travel path of the top drive between the borehole centre and the retracted position. The expander device that enables this travel path must be designed accordingly. The greater the travel path, the greater the forces acting on the expander device. Thus, a smaller distance between the retracted position and the borehole centre, which is possible according to the innovation proposed herein, reduces the forces acting on the expander device. This reduced load increases its service life and makes a less complex design of the expander device possible.

In a method for operating such a drilling rig, in particular a method for moving a top drive in a drilling mast of a drilling rig, it is first provided with respect to the drilling mast and the top drive that the drilling mast has a crown bearing at its head end in a manner known per se, wherein the crown bearing usually functions as a top block of a pulley system or such a top block is suspended below the crown bearing, wherein the top drive is suspended from a bottom block of the pulley system, referred to in technical terminology as a travelling block, and that the top drive is vertically movable in the drilling mast, namely along a vertical axis of the drilling mast, by means of the pulley system and is moved during operation of the drilling rig.

The special feature of the method is that the crown bearing is movable by means of a positioning device (crown bearing positioning device) at least between a first position (borehole centre) and a second position (retracted position) and is moved by the positioning device into the first or the second position as required during operation of the drilling rig. The crown bearing is preferably translationally movable, namely translationally in a direction transverse to the direction of movement of the top drive in the mast. When installing and removing a drill string, the crown bearing is moved by means of the positioning device and the top drive is moved by means of an expander device of the type described above into the borehole centre position when the drill string is to be raised, lowered or rotated with the top drive. Due to an appropriate positioning of the positioning device, the crown bearing is located in the borehole centre position when the drill string is lifted, lowered or rotated with the top drive, i.e. generally whenever the drill string is suspended from the top drive. During an idle run of the top drive, the crown bearing is located in the retracted position due to appropriate positioning of the positioning device and the crown bearing is moved to the retracted position by the positioning device when the top drive is to perform an idle run.

For the further description, in order to avoid unnecessary repetition, it applies that features and details described in connection with the method for operating a drilling rig or the method for moving a top drive in a drilling mast of a drilling rig, as well as possible embodiments, naturally also apply to a drilling rig set up for carrying out the method or a drilling mast set up for carrying out the method, and vice versa. Accordingly, the method may also be advanced by means of one or a plurality of method features relating to method steps carried out by the drilling rig, and the drilling rig or drilling mast may accordingly also be advanced by means for carrying out method steps carried out as part of the method. Consequently, features and details described in connection with the method proposed herein and any embodiments thereof are, of course, also applicable in connection with and with respect to the apparatus proposed herein and any embodiments thereof, and vice versa in each case, so that reference is or may always be made mutually with respect to the disclosure concerning the individual aspects of the invention.

Advantageous embodiments of the invention are the subject of the subclaims. In this regard, back references used within the claims indicate further formation of the subject matter of the referenced claim by the features of the respective dependent claim. They are not to be understood as a waiver of obtaining independent, subject-matter protection for the features or feature combinations of a dependent claim. Furthermore, with regard to an interpretation of the claims as well as of the description, it is to be assumed in the case of a more detailed specification of a feature in a dependent claim that such a limitation is not present in the respective preceding claims as well as in a more general embodiment of the present method/the present drilling rig or the present drilling mast. Any reference in the description to aspects of dependent claims must therefore be read expressly as a description of optional features, even in the absence of a specific reference.

In one embodiment of the apparatus proposed herein (drilling rig with a positioning device and a crown bearing movable by means of the positioning device; drilling mast with a positioning device and a crown bearing movable by means of the positioning device), a travel path for the crown bearing is provided at the head end of the drilling mast, and a travelling device or a displacement device acts as the positioning device, which travelling device or displacement device is designed and set up for moving, namely for travelling (moving) or displacing (shifting), the crown bearing in, on or at the travel path. At least one rail, in particular a guide rail, or a sectional steel acting as a rail or guide rail, in particular a sectional steel with a U-profile or a T-profile, can be employed to function as the travel path. Likewise, a toothed rack can be employed to function as the travel path. Mixed forms are also conceivable, i.e. a travel path which comprises on the one hand a toothed rack and on the other hand a rail, in particular a guide rail, or a sectional steel acting as a rail or guide rail.

A drive acting on the one hand on the crown bearing and on the other hand either on the drilling mast or directly on the travel path preferably acts as the positioning device, or the positioning device comprises such a drive. For example, a hydraulic cylinder or a pneumatic cylinder can be employed as the drive. As far as the drive engages on the drilling mast or directly on the travel path, it engages at a stationary point from which the crown bearing can be moved, in the case of a hydraulic or pneumatic cylinder in a manner known per se by retracting and extending a piston rod. Alternatively, a wire rope hoist can be employed as the drive, which moves the crown bearing along the travel path in the manner of a so-called trolley. Alternatively, a motor drive, in particular an electric motor or a hydraulic motor, can also be employed as the drive, which drives a drive wheel, which engages in the travel path or engages on the travel path and runs in, on or at the travel path. Such a drive also engages with the crown bearing on the one hand and with the travel path on the other hand and thus at least indirectly on the drill mast. Preferably, the drive is connected to the crown bearing, in particular attached to the crown bearing. A further possibility for a drive is a drive which is connected to the travel path or to the drilling mast, in particular is attached to the travel path or to the drill mast, and which drives a drive wheel which acts on the movable crown bearing in a frictional or positive manner. Then, for example, a toothed rack is attached to the crown bearing in which the drive wheel engages.

Overall, according to the approach proposed herein, it is advantageously provided that during and for installing a drill string in a borehole or during and for removing a drill string from a borehole, respective methods comprising the following method steps are carried out:

When removing a drill string from the borehole, the drill string is pulled out of the borehole piece by piece by means of the top drive, and in each case by way of a load run of the top drive and an upward movement of the top drive in the drill mast. At the end of a load run of the top drive, the drill string is held by another machine and the top drive is uncoupled from the drill string. After uncoupling the top drive from the drill string, the crown bearing is moved to the second position (retracted position) by means of the positioning device and the top drive is moved to the second position (retracted position) by means of the expander device and the top drive is moved downwards in the drill mast by means of an idle run, parallel to the axis of the drill string and at a distance from the position above the borehole centre. During the load run of the top drive, the crown bearing is in the position above the borehole centre. During the idle run, the crown bearing is in the retracted position.

When installing a drill string in a borehole, the drill string is lowered into the borehole piece by piece by means of the top drive, in each case by way of a load run of the top drive and a downward movement of the top drive in the drill mast. At the end of a load run of the top drive, the drill string is held by another machine and the top drive is uncoupled from the drill string. After uncoupling the top drive from the drill string, the crown bearing and the top drive are moved to the second position (retracted position) and the top drive is moved upwards in the drill mast by way of an idle run, parallel to the axis of the drill string and at a distance from the position above the borehole centre. Here, too, the crown bearing is in the position above the borehole centre during a load run of the top drive and in the retracted position during an idle run.

Especially in the case of a movable crown bearing (movable at least between the position above the borehole centre and a retracted position) as well as a top drive movable in the same manner—in each case by means of a positioning device or an expander device—the entire apparatus for raising, lowering and rotating a drill string in the mast is movable between the position above the borehole centre and a retracted position, so that altogether one can also speak of a retractable hoisting system in the mast (Retractable Hoisting System) and the invention is to that extent in its most general form such a retractable hoisting system.

An idle run in the retracted position following a load run is preferably automatic or semiautomatic. Moving the crown bearing into the retracted position and a subsequent idle run of the top drive are permissible if, on the one hand, the drill string is axially fixed and, if necessary, an extracted drilling rod element is held or is at least guided by means of another machine and, on the other hand, the top drive is uncoupled from the drill string. Both conditions can be monitored automatically by means of a control device and are optionally monitored automatically by means of a control device. If at least the two aforementioned conditions are fulfilled, the crown bearing is moved into the retracted position automatically or following an operator action (optimally simultaneously or at least in temporal connection with a movement of the top drive into the retracted position by means of the expander device), and optionally, following the reaching of the retracted position, the idle run of the top drive in the retracted position takes place automatically or following a further operator action.

Similarly, monitoring of access to an area above the borehole centre by other machines or another machine, for example a rod handling device, is automatic or semi-automatic and under the control of a control device. As soon as the crown bearing has been moved into the retracted position by means of the positioning device and the top drive has also been moved into the retracted position by means of the expander device, the region above the borehole centre is basically clear for other machines. When the region above the borehole centre is clear, access to the region above the borehole centre is clear for a rod handling device or the like and by means of the rod handling device, for example, a drilling rod element separated from the drill string is removed from the region above the borehole centre (when removing the drill string) or a drilling rod element to be connected to the drill string is brought into the region above the borehole centre (when installing the drill string).

The claims filed with the application are formulation proposals without prejudice to obtaining further patent protection. Since, in particular, the features of the dependent claims may form separate and independent inventions in view of the prior art at the priority date, the applicant reserves the right to make these or still further combinations of features, hitherto disclosed only in the description and/or drawing, the subject matter of independent claims or divisional applications. They may further contain independent inventions having a configuration independent of the subject matter of the claims referred to in each case.

The object mentioned at the beginning is also achieved with a control device for controlling the movement of a top drive in the drilling mast of a drilling rig, which operates according to the method as described here and in the following and comprises means for carrying out the method for this purpose. A programmable logic controller basically known per se can be employed, for example, to function as the control device. The means for carrying out the method are then the controller itself, input and output channels of the controller and a control program executed by the control device and comprising an implementation of the method and the method steps encompassed by it. Input signals from the drilling rig, in particular from the positioning device, the top drive, the crown bearing and/or the expander device, are acquired via the input channels of the control device. The control program determines a logical combination of such signals with each other and/or with internal status signals of the control device generated in a manner known per se. As a result of such combinations, output signals are produced which are output via the output channels to the drilling system, in particular the positioning device, the top drive, the crown bearing and/or the expander device, and which cause, for example, activation of the positioning device for moving the crown bearing into the first or second position.

For automatic or semi-automatic execution, the method is preferably implemented in the form of a computer program functioning as a control program. The invention is thus also, on the one hand, a computer program with program code instructions which can be executed by a computer, for example a central unit of a programmable logic controller, and, on the other hand, a storage medium with such a computer program, i.e. a computer program product with program code means, and finally also a control device in whose memory such a computer program is loaded or can be loaded as a means for carrying out the method and its embodiments.

Instead of a computer program with individual program code instructions, the implementation of the method described here and in the following can also take the form of firmware. It is clear to the person skilled in the art that instead of an implementation of a method in software, an implementation in firmware or in firmware and software or in firmware and hardware is always possible. Therefore, for the purposes of the description provided herein, it is intended that the terms control program and computer program also encompass other implementation possibilities, namely, in particular, an implementation in firmware or in firmware and software or in firmware and hardware.

In the following, an embodiment example of the invention will be explained in more detail with reference to the drawing. Mutually corresponding objects or elements are provided with the same reference numerals in all figures.

The embodiment example is not to be understood as a limitation of the invention. Rather, within the scope of the present disclosure, additions and modifications are also quite possible, in particular those which, for example, by combination or variation of individual features or process steps described in connection with the general or specific description part and contained in the claims and/or the drawing, can be inferred by the person skilled in the art with regard to achieving the object and, through combinable features, lead to a new object or to new process steps or process step sequences.

DETAIL DESCRIPTION OF ILLUSTRATED EMBODIMENTS

Figure 1:
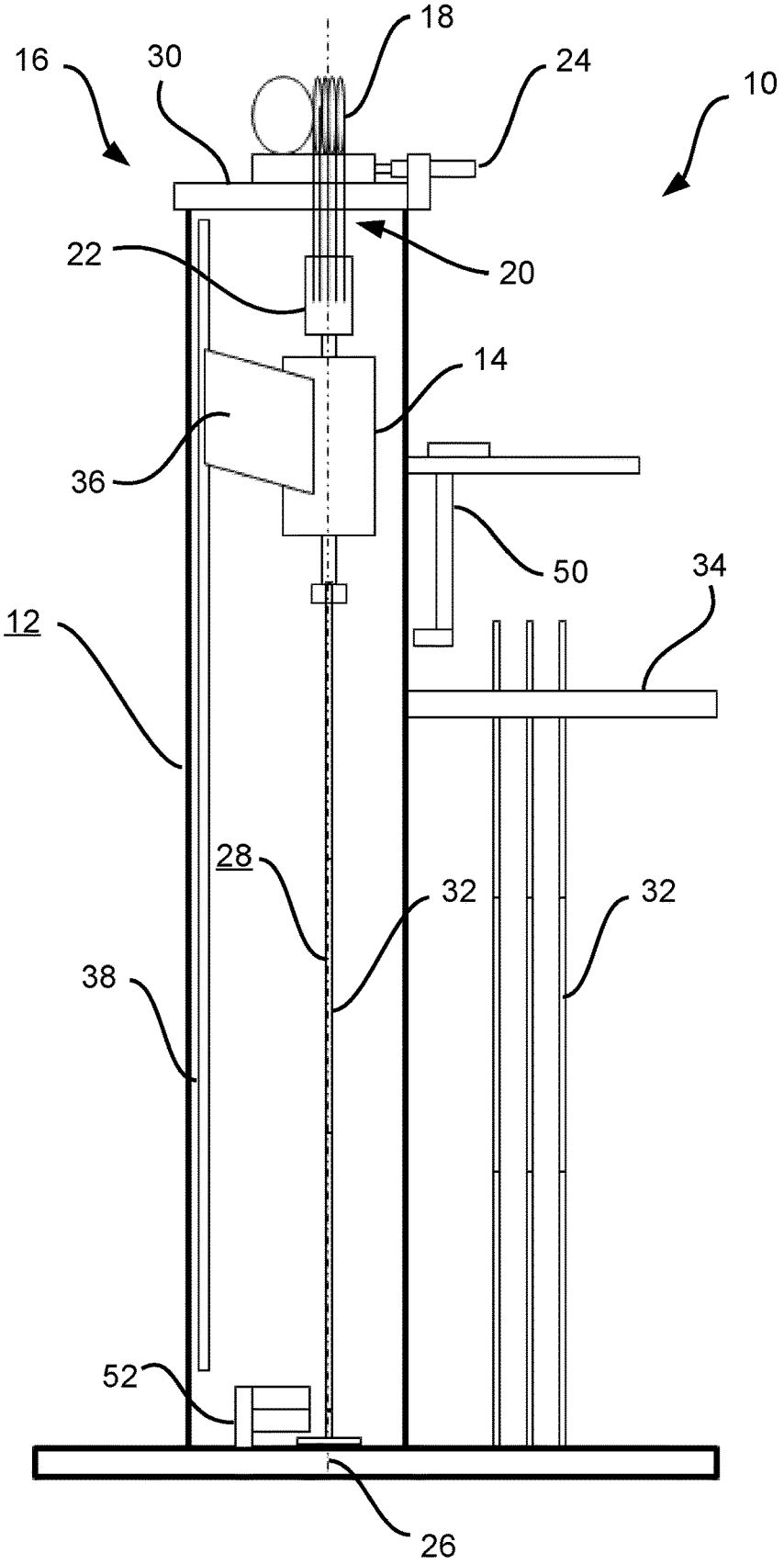
FIG. 1 shows a drill mast of a drilling rig with a top drive movable in the drill mast.

The illustration in FIG. 1 shows—in a schematically highly simplified form—a drilling mast 12 as part of a drilling rig 10. In the drilling mast 12, in a manner basically known per se, a top drive 14 is movable up and down along the vertical axis of the drilling mast 12, i.e. in a vertical direction.

The drilling mast 12 has a so-called crown bearing 18 at its upper end (head end 16) in a manner known per se. In the embodiment shown, this acts as the top block of a pulley system 20 (cable pulley system). A bottom block 22 of the pulley system 20 is suspended below the crown bearing 18. The top drive 14 is suspended from the bottom block 22 and overall from the pulley system 20 and below the crown bearing 18.

The crown bearing 18 is movable between at least a first position and a second position by means of a positioning device 24. As a positioning device 24, a hydraulic cylinder is shown—merely by way of example. Alternatively, the positioning device 24 may be construed as a pneumatic cylinder in the form shown. Optionally, such a positioning device 24 is implemented in the form of a paired arrangement of two hydraulic or pneumatic cylinders. The or each hydraulic or pneumatic cylinder is an example of a drive of a travelling or displacement device engaging directly or indirectly the drilling mast 12, on the one hand, and the crown bearing 18, on the other hand.

In the embodiment shown in FIG. 1, the crown bearing 18 is in a first position, namely in a position in which the top drive 14 is suspended above the borehole machined by means of the drilling rig 10 (borehole centre 26). In the embodiment shown in FIG. 2, the crown bearing 18 is in a second position, namely in a position in which the top drive 14 is not suspended above the borehole centre 26. The position of the borehole centre 26 is the axis (axis of rotation) of the drill string 28.

The first position of the crown bearing 18, in which the top drive 14 is suspended over the borehole centre 26, will also be referred to hereinafter in reference to the position of the crown bearing 18 as the position of the crown bearing 18 over the borehole centre 26 or, for short, borehole centre 26. The second position of the crown bearing 18, in which the top drive 14 is not suspended over the borehole centre 26, is referred to hereinafter as the retracted position for purposes of distinction.

For such mobility of the crown bearing 18 at least between the borehole centre position and the retracted position, a travel path 30 is provided at the head end 16 of the drilling mast 12 in the embodiment shown. The crown bearing 18 is movable along the travel path 30. The positioning device 24 causes movement of the crown bearing 18 along the travel path 30, i.e. movement of the crown bearing 18 to the position above the borehole centre 26 or movement of the crown bearing 18 to the retracted position.

In the position of the crown bearing 18 above the borehole centre 26, so-called load runs of the top drive 14 take place. During a load run of the top drive 14, a drill string 28 rotatable by means of the top drive 14 is suspended from the top drive 14 and is raised, lowered and/or rotated by means of the top drive 14.

In the retracted position of the crown bearing 18, so-called idle runs of the top drive 14 take place. During an idle run, the top drive 14 is uncoupled from the drill string 28. An idle run may be performed in a plane parallel to a plane defined by the borehole and spaced from the borehole centre 26, due to the mobility of the crown bearing 18.

An idle run may already occur with a crown bearing 18 movable in accordance with the innovation proposed herein and a top drive 14 itself movable between a position above the borehole centre 26 and a retracted position when a drill string 28 is still being removed and a drilling rod element 32 is uncoupled from the drill string 28 and set down adjacent to the mast 12, for example in a finger platform 34, or when a new drilling rod element 32 to be coupled to the drill string 28 is moved to the position above the borehole centre 26 during installation of a drill string 28. This saves time when installing and removing the drill string 28 because processes that previously had to be carried out strictly one after the other can now be executed in parallel or at least partially in parallel.

Figure 2:
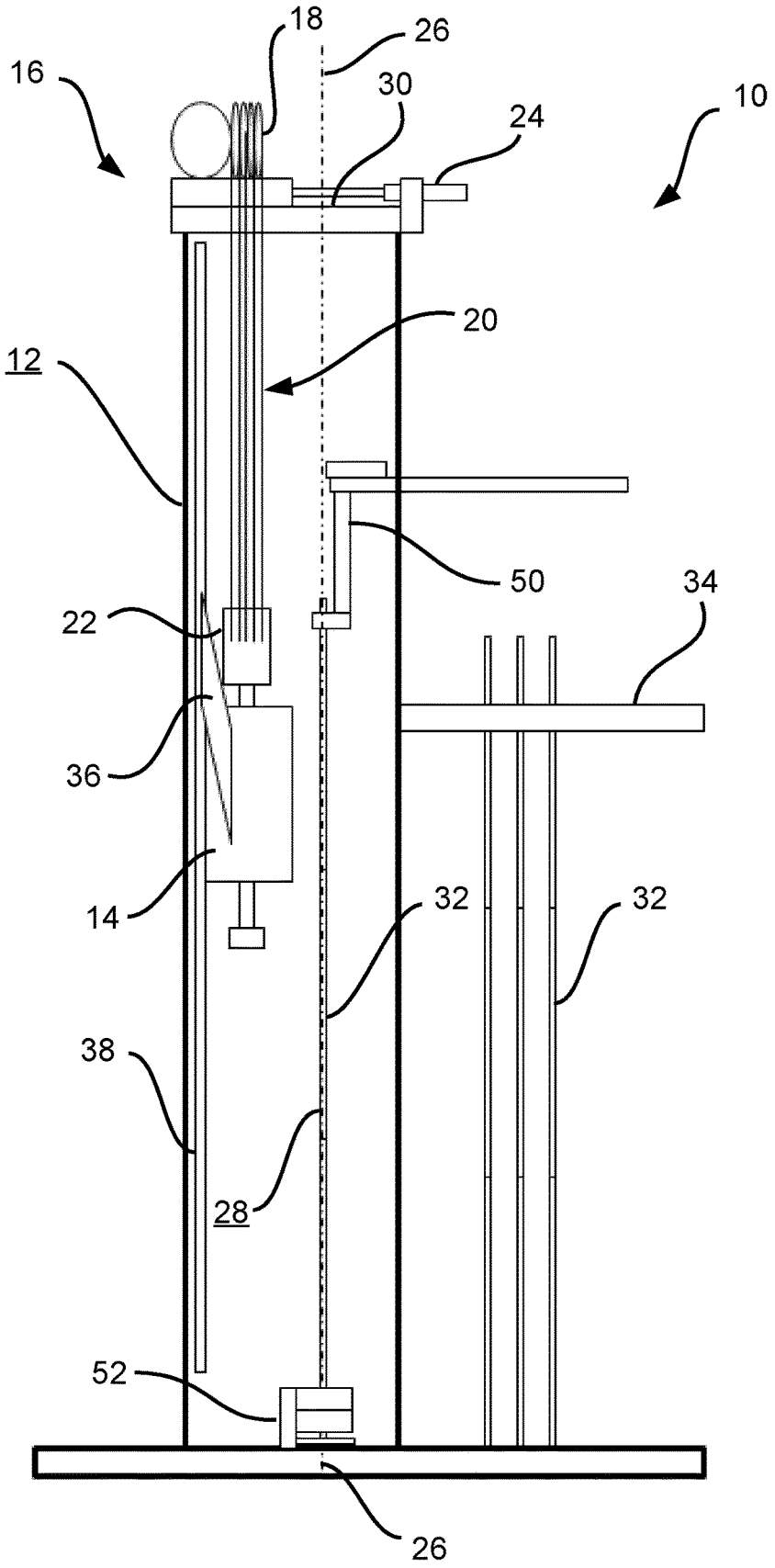
FIG. 2 shows the drill mast as in FIG. 1 with a crown bearing moved from a position above the borehole centre to a retracted position.

In the illustrations in FIG. 1 and FIG. 2, with regard to the mobility of the top drive 14 between the position above the borehole centre 26 and the retracted position, a device for moving the top drive 14 from the retracted position above the borehole centre 26 as well as for moving the top drive 14 from the position above the borehole centre 26 into the retracted position is schematically shown in a highly simplified manner, which is basically known per se and is referred to here as an expander device 36. The expander device 36 engages a guide 38 in or on the drilling mast 12 on one side, and on the opposite side the expander device 36 holds and positions the top drive 14 (the top drive 14 is supported by the pulley system 20). Along the guide 38, the top drive 14 is vertically movable in the drilling mast 12. By means of the expander device 36, the top drive 14 is movable into a plane above the borehole centre 26 (first position) and movable out of the plane above the borehole centre 26 into a retracted position (second position). The top drive 14 is supported on the guide 38 when the drill string 28 is rotated. By means of the expander device 36, the top drive 14 is movable at least into a first plane and into a second plane each parallel to a plane defined by the guide 38.

In the illustration in FIG. 1, a situation is shown in which the top drive 14 is moved by means of the expander device 36 into the first plane, namely a plane which contains an imaginary line extending from the borehole centre 26 along and in continuation of the borehole. A position of the expander device 36 belonging to this plane will be referred to hereinafter—analogously to the position of the crown bearing 18—as the position above the borehole centre 26 or, for short, as the borehole centre 26. In the illustration in FIG. 2, a situation is shown in which the top drive 14 is moved by means of the expander device 36 into the second plane, namely a second plane parallel to the first plane and spaced from the first plane. A position of the expander device 36 belonging to this plane will be referred to hereinafter as a retracted position, also analogous to the position of the crown bearing 18.

In a drilling rig 10 having a movable crown bearing 18 and a top drive 14 movable by means of an expander device 36, the movements of the crown bearing 18 and the expander device 36 are at least coordinated with each other. Simultaneous movement of each of the crown bearing 18 and the expander device 36 (each in the same direction, i.e. either toward the first position or toward the second position) may be provided. In principle, the movements can also take place at different times or one after the other, but even then they always take place in the same direction.

Figure 3:
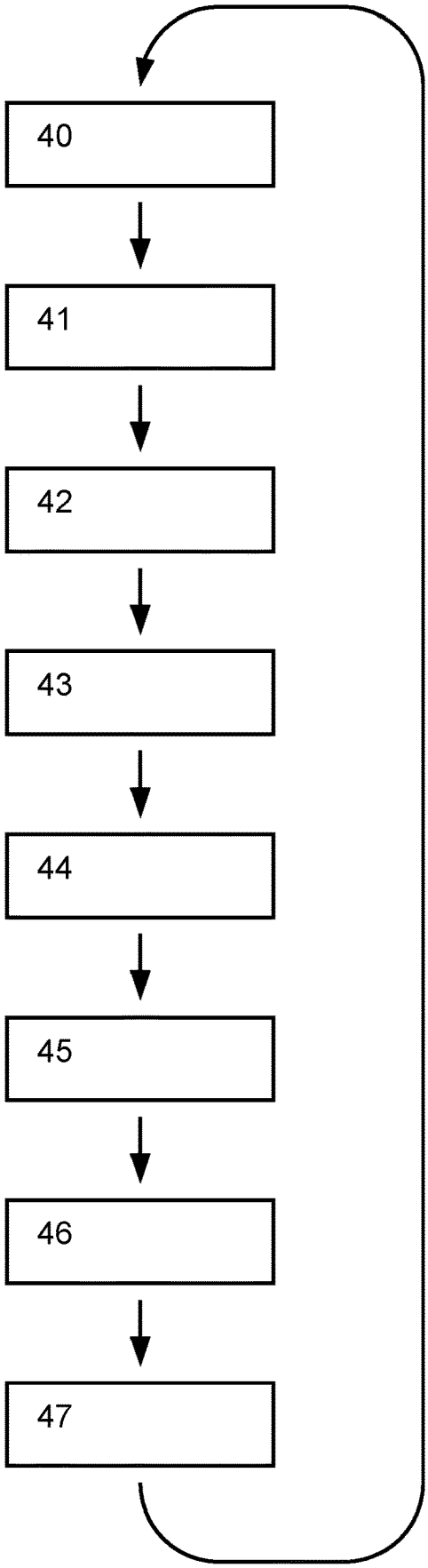
FIG. 3 shows a schematically simplified sequence of a procedure for removing a drill string from a borehole.

When removing the drill string 28, for example, the following schematically simplified process steps shown in the illustration in FIG. 3 had to be carried out in succession up to now (an equally possible variant of the sequence of steps is mentioned in the introduction to the description):

- Extracting the drill string 28 from the borehole piece by piece by means of the top drive 14 (first step 40);
- fixing the drill string 28 for load transfer from the top drive 14 (second step 41);
- guiding the extracted drilling rod element 32 by means of another machine, for example by means of a pipe handler 50 (third step 42);
- uncoupling the top drive 14 from the drill string 28 (fourth step 43);
- separating the extracted drilling rod element 32 from the drill string 28 by means of a tong system 52 (fifth step 44);
- removing the drilling rod element 32 separated from the drill string 28 from the region above the borehole centre 26, for example by means of a pipe handler 50 (sixth step 45);
- lowering the top drive 14 towards the end of the drill string 28 (seventh step 46);
- coupling the top drive 14 to the drill string 28 (eighth step 47);
- extracting the drill string 28 from the borehole piece by piece by means of the top drive 14 (first step 40), and so on.

Figure 4:
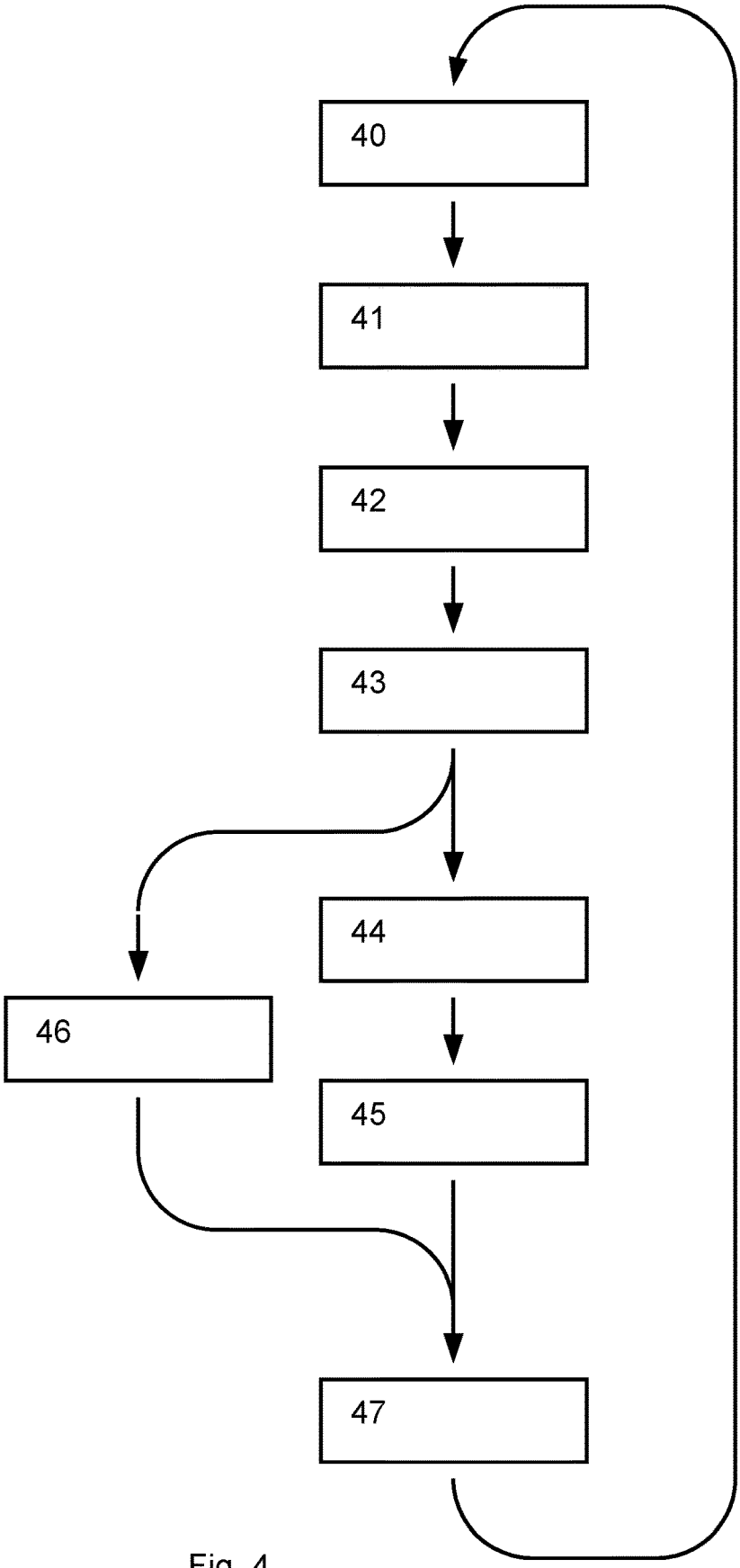
FIG. 4 shows the process of removing a drill string according to the approach proposed herein.

Now, according to the approach proposed here, the process steps "separating the extracted drilling rod element 32 from the drill string 28" (fifth step 44) and "removing the drilling rod element 32 separated from the drill string 28 from the region above the borehole centre 26" (sixth step 45) as well as the process step "lowering the top drive 14 towards the end of the drill string 28" (seventh step 46) can be carried out in parallel, as shown schematically simplified in the illustration in FIG. 4.

For this purpose, the crown bearing 18 is moved to the retracted position by means of the positioning device 24 and the top drive 14 is moved to the retracted position by means of the expander device 36 after the top drive 14 has been uncoupled from the drill string 28. Subsequently, or optionally already during the movement of the crown bearing 18 and/or the expander device 36 into the retracted position, the top drive 14 is lowered. Once the drilling rod element 32, which is separated from the drill string 28, is removed from the region above the borehole centre 26, the crown bearing 18 by means of the positioning device 24 and the top drive 14 by means of the expander device 36 can be moved back to the position above the borehole centre 26. If the top drive 14 is still in downward movement when this condition is fulfilled, these movements (downward movement of the top drive 14 on the one hand and movement of the crown bearing 18 by means of the positioning device 24 and movement of the top drive 14 by means of the expander device 36 on the other hand) can also be carried out in parallel.

In any case, when moving in the retracted position, the top drive 14 is regularly already at the level of the end of the drill string 28 when, in parallel, the sixth process step 45 (removal of the drill string element 32 from the region above the borehole centre 26) is completed. Without the innovation proposed herein, the lowering of the top drive 14 would not begin until now, i.e. until after the end of the sixth process step 45. Thus, removal of a drilling rod element 32 is now faster than in the prior art. This time saving is multiplied when removing a complete drill string 28. The same applies accordingly to the (re)installation of the drill string 28.

Although the invention has been further illustrated and described in detail by the example embodiment, the invention is not limited by the example or examples disclosed and other variations may be derived therefrom by the person skilled in the art without departing from the scope of protection of the invention.

Individual aspects of the description submitted here that are in the foreground can thus be briefly summarised as follows: Disclosed are a land drilling rig 10 having a drilling mast 12, a top drive 14 movable in the drilling mast 12 along the vertical axis of the drilling mast 12, and a crown bearing 18 at an upper end 16 of the drilling mast 12, the crown bearing 18 being movable by means of a positioning device 24, and a method of operating such a drilling rig 10 and a method of operating a top drive 14 in the drilling mast of such a drilling rig 10.

LIST OF REFERENCE NUMERALS

10 Drilling rig
12 Drilling mast
14 Top drive
16 Head end (of the drilling mast)
18 Crown bearing
20 Pulley system
22 Bottom block
24 Positioning device
26 Borehole centre
28 Drill string
30 Travel path
32 Drilling rod element
34 Finger stage
36 Expander device
38 Guide
40 (First) step (when removing a drill string)
41 (Second) step (when removing a drill string)
42 (Third) step (when removing a drill string)
43 (Fourth) step (when removing a drill string)
44 (Fifth) step (when removing a drill string)
45 (Sixth) step (when removing a drill string)
46 (Seventh) step (when removing a drill string)
47 (Eighth) step (when removing a drill string)
50 Pipe handler
52 Tong system

The invention claimed is:

1. A land drilling rig (10), comprising:
a drilling mast (12),
a top drive (14) movable in the drilling mast (12) along the vertical axis of the drilling mast (12) and
a crown bearing (18) at an upper end (16) of the drilling mast (12),
wherein the crown bearing (18) is movable by means of a positioning device (24) in a first direction, and
wherein the top drive (14) is vertically movable in the drilling mast (12) along a guide (38), characterized in that:
the top drive (14) is movable by means of an expander device (36) in the same first direction as the positioning device (24) at least into a first plane and into a second plane each parallel to a plane defined by the guide (38),
the expander device (36) engages the guide (38) directly or indirectly and the top drive (14) is located at the opposite end of the expander device (36),
the expander device (36) moves with the top drive (14) along the guide (38) in the mast (12), and
the positioning device (24) and the expander device (36) are activated substantially synchronously to move the crown bearing (18) and the top drive (14) in the first direction.

2. The drilling rig according to claim 1, further comprising:
a travel path (30) for the crown bearing (18) at the upper end of the drilling mast (12); and
a travelling or displacement device acting as the positioning device (24).

3. The drilling rig according to claim 2, further comprising
a drive acting on the one hand on the drilling mast (12) and on the other hand on the crown bearing (18) as the travelling or displacement device.

4. The drilling rig according to claim 3, further comprising at least one drive wheel rotatable by means of the drive (motor drive, electric motor) and running in, on or at the travel path (30).

5. The drilling rig according to claim 2, wherein the travelling or displacement device comprises at least one drive wheel rotatable by means of a drive (motor drive, electric motor) and running in, on or at the travel path (30).

6. A method of moving a top drive (14) in a drilling mast (12) of a land drilling rig (10),
wherein the drilling mast (12) has a crown bearing (18) at a head end (16),
wherein the top drive (14) is suspended from a pulley system (20) below a crown bearing (18),
wherein the top drive (14) is movable vertically in the drilling mast (12) by means of the pulley system (20) and along a guide (38),
wherein the crown bearing (18) is movable back and forth by means of a positioning device (24) in a first direction at least between a first position above a borehole centre (26) and a second position remote from the position above the borehole centre (26),
wherein the top drive (14) is movable by means of an expander device (36) in the same first direction as the positioning device (24) at least into a first plane and into a second plane each parallel to a plane defined by the guide (38),
wherein the crown bearing (18) is movable for a load run of the top drive (14) to the first position above the borehole centre (26),
wherein the crown bearing (18) is movable for an idle run of the top drive (14) to the second position remote from the position above the borehole centre (26), and
wherein the method comprises moving the top drive (14) by means of an expander device (36) between the first and the second position, for a load run to the first position over the borehole centre (26) and for an idle run to the second position remote from the position over the borehole centre (26), wherein moving the top drive (14) comprises activating the positioning device (24) and the expander device (36) substantially synchronously to move the crown bearing (18) and the top drive (14) in the first direction.

7. The method according to claim 6, wherein movement of the crown bearing (18) to the first or second position is coordinated with the movement of the top drive (14) to the first or second position.

8. The method according to claim 7, wherein during a removal of the drill string (28) from the borehole, the drill string (28) is pulled out of the borehole by means of the top drive (14) piece by piece and in each case by way of a load run of the top drive (14) and an upward movement of the top drive (14) in the drilling mast (12), wherein, when the drill string (28) is removed at the end of a load run of the top drive (14), the drill string (28) is held independently of the top drive (14) and the top drive (14) is uncoupled from the drill string (28), wherein, after the top drive (14) has been uncoupled from the drill string (28), the crown bearing (18) is moved into the second position, in particular the crown bearing (18) and the top drive (14) are moved into the second position, and the top drive (14) is moved downwards in the drilling mast (12) by way of an idle run.

9. The method according to claim 8, wherein, during installation of the drill string (28) in a borehole, the drill string (28) is lowered into the borehole by means of the top drive (14) piece by piece and in each case by way of a load run of the top drive (14) and a downward movement of the top drive (14) in the drilling mast (12), wherein during installation of the drill string (28) at the end of a load run of the top drive (14) the drill string (28) is held independently of the top drive (14) and the top drive (14) is uncoupled from the drill string (28), wherein after uncoupling the top drive (14) from the drill string (28), the crown bearing (18) is moved into the second position, in particular the crown bearing (18) and the top drive (14) are moved into the second position, and the top drive (14) is moved upwards in the drilling mast (12) by way of an idle run.

10. The method according to claim 6, wherein during a removal of the drill string (28) from the borehole, the drill string (28) is pulled out of the borehole by means of the top drive (14) piece by piece and in each case by way of a load run of the top drive (14) and an upward movement of the top drive (14) in the drilling mast (12), wherein, when the drill string (28) is removed at the end of a load run of the top drive (14), the drill string (28) is held independently of the top drive (14) and the top drive (14) is uncoupled from the drill string (28), wherein, after the top drive (14) has been uncoupled from the drill string (28), the crown bearing (18) is moved into the second position, in particular the crown bearing (18) and the top drive (14) are moved into the second position, and the top drive (14) is moved downwards in the drilling mast (12) by way of an idle run.

11. The method according to claim 10, wherein, during installation of the drill string (28) in a borehole, the drill string (28) is lowered into the borehole by means of the top drive (14) piece by piece and in each case by way of a load run of the top drive (14) and a downward movement of the top drive (14) in the drilling mast (12), wherein during installation of the drill string (28) at the end of a load run of the top drive (14) the drill string (28) is held independently of the top drive (14) and the top drive (14) is uncoupled from the drill string (28), wherein after uncoupling the top drive (14) from the drill string (28), the crown bearing (18) is moved into the second position, in particular the crown bearing (18) and the top drive (14) are moved into the second position, and the top drive (14) is moved upwards in the drilling mast (12) by way of an idle run.

* * * * *